US007102630B2

(12) United States Patent
Liu et al.

(10) Patent No.: US 7,102,630 B2
(45) Date of Patent: Sep. 5, 2006

(54) DISPLAY DRIVING CIRCUIT

(75) Inventors: Biing-Der Liu, Taipei (TW); Jia-Fam Wong, Hsinchu (TW); Yao-Jen Hsieh, Pingtung (TW)

(73) Assignee: AU Optronics Corp., Hsinchu (TW)

( * ) Notice: Subject to any disclaimer, the term of this patent is extended or adjusted under 35 U.S.C. 154(b) by 370 days.

(21) Appl. No.: 10/411,935

(22) Filed: Apr. 11, 2003

(65) Prior Publication Data

US 2003/0193490 A1 Oct. 16, 2003

(30) Foreign Application Priority Data

Apr. 11, 2002 (TW) ..... 91107355 A

(51) Int. Cl.
*G09G 5/00* (2006.01)

(52) U.S. Cl. ..... 345/204; 345/92; 345/98

(58) Field of Classification Search ..... 345/87, 345/90, 92, 93, 94, 95, 96, 98, 204, 205
See application file for complete search history.

(56) References Cited

U.S. PATENT DOCUMENTS 4,873,516 A * 10/1989 Castleberry ..... 345/58
5,253,091 A * 10/1993 Kimura et al. ..... 345/94
5,313,222 A * 5/1994 Lee ..... 345/58
6,011,531 A * 1/2000 Mei et al. ..... 345/92
6,011,534 A * 1/2000 Tanaka et al. ..... 345/98
6,593,905 B1 * 7/2003 Lay ..... 345/92
6,646,637 B1 * 11/2003 Kageyama et al. ..... 345/204
6,933,910 B1 8/2005 Kodate et al.

* cited by examiner

*Primary Examiner*—Richard HJerpe
*Assistant Examiner*—Jean Lesperance
(74) *Attorney, Agent, or Firm*—Fish & Richardson P.C.

(57) ABSTRACT

A display driving circuit. The circuit comprises a data driver outputting a first, second, third and fourth data signal through a data line, a scan driver outputting a first and second scan signal through a first and second scan line, a first, second, third and fourth display cell receiving the first, second, third and fourth data signal through the data line and receiving the first and second scan signal through the first and second scan line, a first switch coupling the first display cell to the data line when the first scan and data signals are asserted, and isolating them from each other when the first scan and second data signals are asserted, and a second switch coupling the third display cell to the data line when the second scan and third data signals are asserted, and isolating them from each other when the second scan and fourth data signals are asserted.

13 Claims, 9 Drawing Sheets

DISPLAY DRIVING CIRCUIT

BACKGROUND OF THE INVENTION

1. Field of the Invention

The present invention relates to a display driving circuit and particularly to a display driving circuit with fewer data drivers.

2. Description of the Prior Art

FIG. 1 is a diagram showing a conventional display driving circuit 1. It includes two data drivers 121 and 122, a scan driver 11, a pixel matrix composed of display cells 13, and switches 161 and 162 composed of transistors. Each of the display cells 13 in the odd columns of the pixel matrix receives a data signal through a data line 151 from the data driver 121 or 122. Each of the display cells 13 in the even columns of the pixel matrix receives a data signal through a data line 152 from the data driver 121 or 122. The display cells 13 also receive scan signals through scan lines 14 from the scan driver 11. To reduce the number of the data drivers, data line 151 and 152 are respectively coupled to the display cells 13 in the odd and even column of the pixel matrix share the same data terminal as the data driver through the switches 161 and 162 controlled by signals SW1 and SW2. When one of the scan signals is asserted, the odd and even display cells 13 in the scanned row of the matrix receive the data signal output from the same terminal of the data driver 121 or 122 by turns. In FIG. 1, for example, the number of the data drivers is half of that not using the switches to share the data terminals since each data terminal provides the data signals to two columns of display cells of the pixel matrix.

However, in the conventional display driving circuit, the switching frequency of the switches 161 and 162 is n times the frame rate, wherein n is the number of the columns in the pixel matrix. For example, the switching frequency of the switches in a display having 768 pixel columns and a frame rate of 60 Hz. is 46080 Hz. Such a switching frequency is much higher than that of the thin-film transistors (TFTs) used in the display cells 13. This results in high current stress which degrades the reliability of the circuit.

SUMMARY OF THE INVENTION

The object of the present invention is to provide a display driving circuit with switches for data terminal sharing individually for each of display cells. This lowers the switching frequency of the switches.

The present invention provides a display driving circuit comprising a data driver sequentially outputting a first, second, third and fourth data signal through a data line, a scan driver outputting a first and second scan signal through a first and second scan line respectively, a first, second, third and fourth display cell respectively receiving the first, second, third and fourth data signal through the data line, the first and second display cell commonly receiving the first scan signal through the first scan line, and the third and fourth display cell commonly receiving the second scan signal through the second scan line, and a first and second switch, the first switch electrically coupling the first display cell to the data line when the first scan and data signals are asserted, and electrically isolating the first display cell from the data line when the first scan and second data signals are asserted, and the second switch electrically coupling the third display cell to the data line when the second scan and third data signals are asserted, and electrically isolating the first display cell from the data line when the second scan and fourth data signals are asserted.

The present invention provides another display driving circuit comprising a data driver sequentially outputting a first, second, third and fourth data signal through a data line, a scan driver outputting a first and second scan signal through a first and second scan line respectively, a first, second, third and fourth display cell respectively receiving the first, second, third and fourth data signal through the data line, the first and second display cell commonly receiving the first scan signal through the first scan line, and the third and fourth display cell commonly receiving the second scan signal through the second scan line, and a first and second switch, the first switch electrically coupling the first display cell to receive a swing signal when the first scan signal is asserted, wherein the swing signal is asserted to couple the first display cell to receive the first data signal when the first data signal is asserted, and the second switch electrically coupling the third display cell to receive the swing signal when the second scan signal is asserted, wherein the swing signal is asserted to couple the third display cell to receive the third data signal when the third data signal is asserted.

The present invention provides still another display driving circuit comprising a data driver sequentially outputting a data signal through a data line, a scan driver outputting a scan signal through a scan line, a first transistor having a gate coupled to the scan line and a drain coupled to the data line, a second transistor having a gate coupled to receive a swing signal and a drain coupled to the data line, and being sequentially turned on and off by the swing signal when the scan signal is asserted, a third transistor having a gate coupled to the scan line and a drain coupled to a source of the second transistor, and a first and second capacitor respectively coupled to sources of the first and third transistor.

The present invention further provides a display driving circuit comprising a data driver sequentially outputting a data signal through a data line, a scan driver outputting a scan signal through a scan line, a first transistor having a gate coupled to the scan line and a drain coupled to the data line, a second transistor having a drain coupled to the data line, a third transistor having a gate coupled to the scan line, a source coupled to a gate of the second transistor and a drain coupled to receive a swing signal, wherein when the scan signal is asserted, the third transistor is turned on to electrically couple the gate of the third transistor to receive the swing signal and the second transistor is sequentially turned on and off, and a first and second capacitor respectively coupled to the sources of the first and third transistor.

Thus, in the present invention, each pair of display cells are equipped with a switch for data terminal sharing. The switching frequency of the switches is lowered to the frame rate, which eliminates the reliability issue in the conventional display driving circuit.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
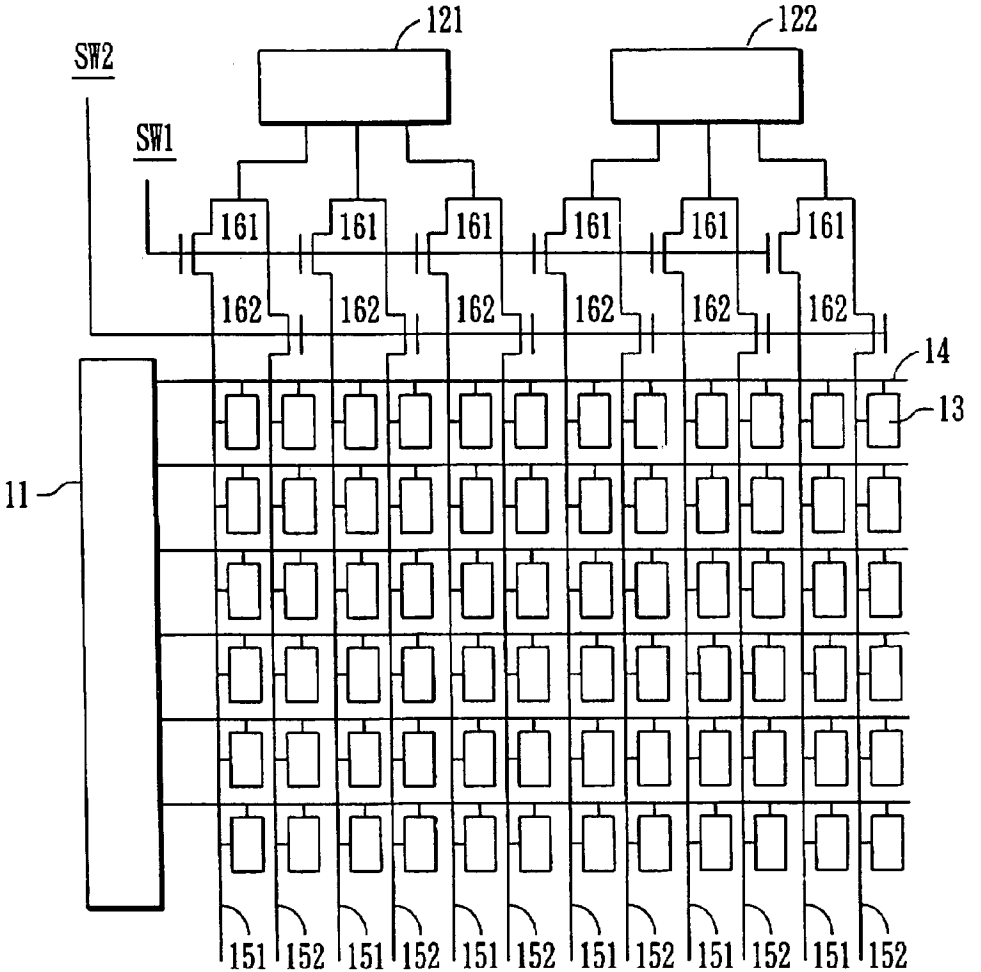
FIG. 1 (PRIOR ART)
FIG. 1 is a diagram showing a conventional display driving circuit.
Figure 2A:
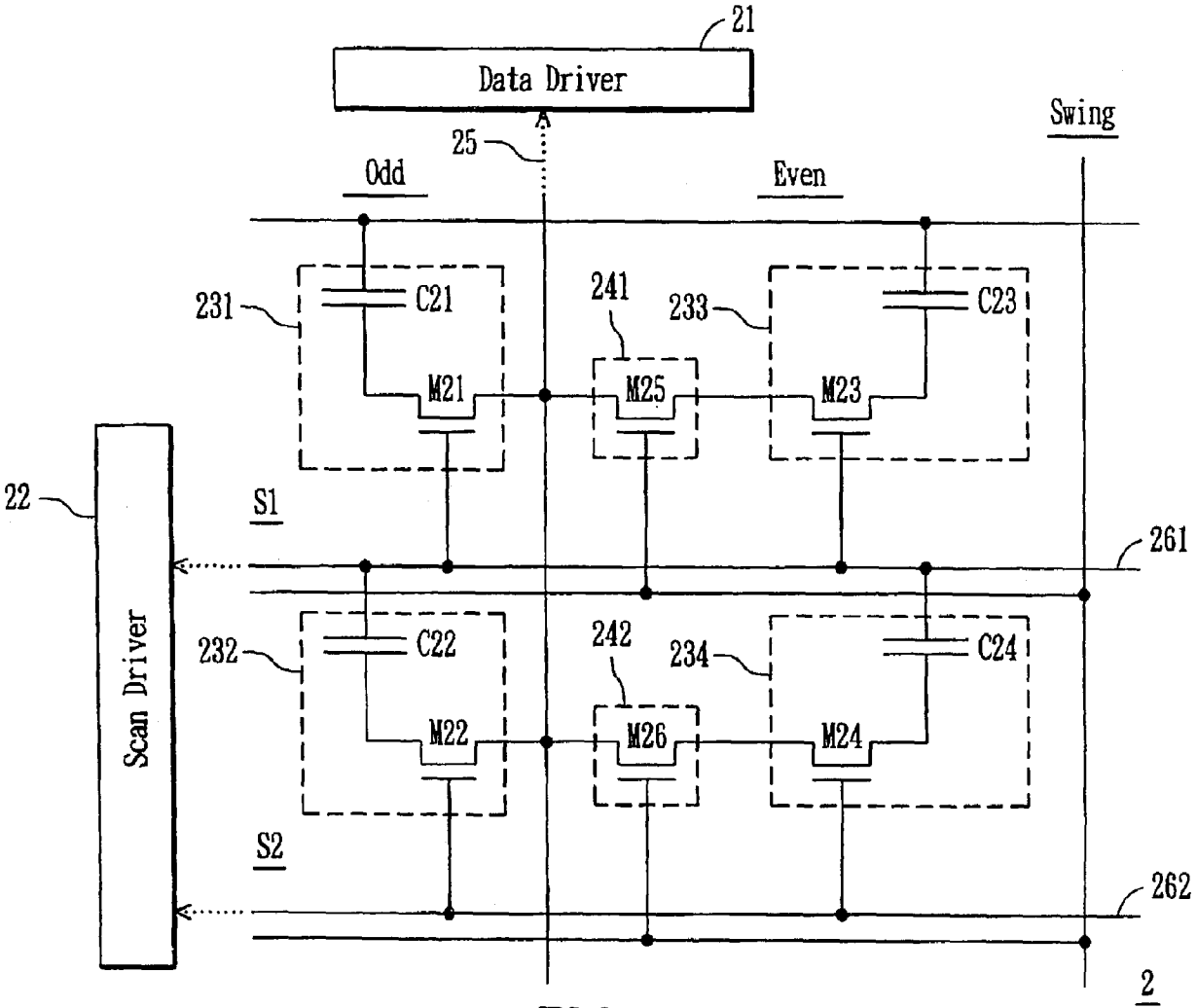
FIGS. 2A and 2B are diagrams showing a display driving circuit and signal timing thereof according to a first embodiment of the invention.

FIG. 2A is a diagram showing a display driving circuit 2 according to a first embodiment of the invention. It includes a data driver 21, a scan driver 22, a pixel matrix composed of four (for example) display cells 231~234, and two switches 241 and 242. The data driver 21 outputs data signals for the display cells 231~234 through a data line 25. The scan driver 22 outputs scan signals S1 and S2 through scan lines 261 and 262. The display cells 231 and 233 commonly receive the scan signal S1 through the scan line 261, and the display cells 232 and 234 commonly receive the scan signal S2 through the scan line 262. The display cells 231~234 respectively receive the corresponding data signals commonly through the data line 25. The switches 241 and 242 are respectively coupled between the data line 25 and the display cell 233, and between the data line 25 and the display cell 234.

The display cells 231 and 232 in the odd columns of the pixel matrix are respectively composed of a transistor M21 and a capacitor C21, and a transistor M22 and C22. The transistor M21 and M22 have gates respectively coupled to the scan lines 261 and 262, drains commonly coupled to the data line 25, and sources coupled to the capacitors C21 and C22. The display cells 233 and 234 in the even columns of the pixel matrix are respectively composed of a transistor M23 and a capacitor C23, and a transistor M24 and C24. The transistor M23 and M24 have gates respectively coupled to the scan lines 261 and 262, drains respectively coupled to the switches 241 and 242, and sources coupled to the capacitors C23 and C24. The switches 241 and 242 are transistors M25 and M26 respectively. The transistors M25 and M26 have gates coupled to receive a signal Swing and drains coupled to the data line 25.

Figure 2B:
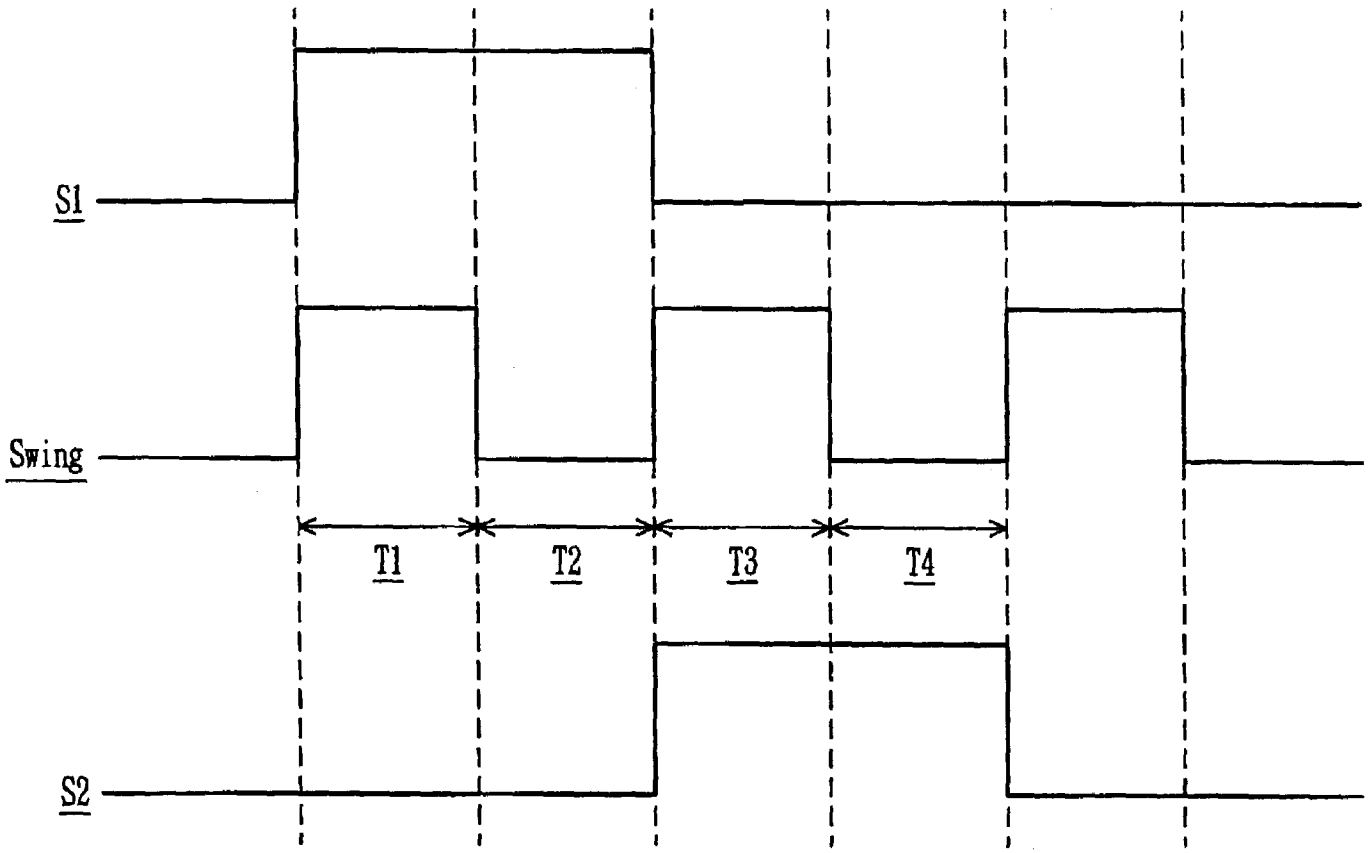

FIG. 2B is a diagram showing signal timing of the driving circuit in FIG. 2A.

The scan period when the scan signal S1 is asserted (has a logic high level) is divided into two sub-periods T1 and T2. During the period T1, the signal Swing is asserted (has a logic high level) and turns on the transistor M25 (closes the switch 241). The display cell 233 in the even column of the pixel matrix receives the data signal from the data driver 21 through the data line 25. During the period T2, the transistor M25 is turned off (the switch 241 is opened) by the signal Swing. The display cell 231 in the odd column of the pixel matrix receives the data signal from the data driver 21 through the data line 25. It is noted that although the display cell 231 also receives the data signal for the display cell 233 during the period T1, it is refreshed by the data signal received during the period T2.

The next scan period when the scan signal S2 is asserted (has a logic high level) is divided into two sub-periods T3 and T4. During the period T3, the signal Swing is asserted (has a logic high level) and turns on the transistor M26 (closes the switch 242). The display cell 234 in the even column of the pixel matrix receives the data signal from the data driver 21 through the data line 25. During the period T4, the transistor M26 is turned off (the switch 242 is opened) by the signal Swing. The display cell 232 in the odd column of the pixel matrix receives the data signal from the data driver 21 through the data line 25. It is noted that although the display cell 232 also receives the data signal for the display cell 234 during the period T3, it is refreshed by the data signal received during the period T4.

Figure 3A:
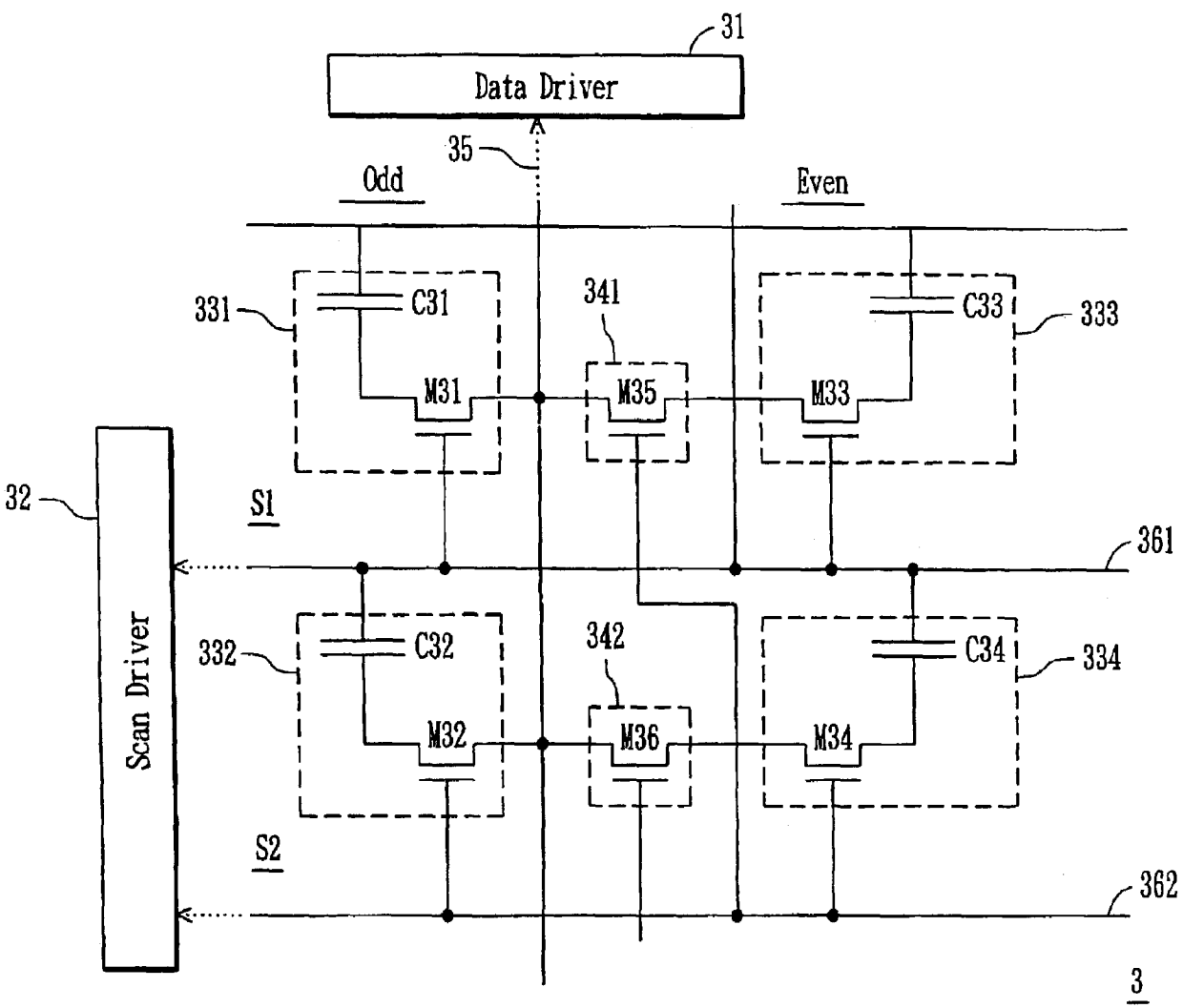
FIGS. 3A and 3B are diagrams showing a display driving circuit and signal timing thereof according to a second embodiment of the invention.

FIG. 3A is a diagram showing a display driving circuit 3 according to a second embodiment of the invention. It includes a data driver 31, a scan driver 32, a pixel matrix composed of four (for example) display cells 331~334, and two switches 341 and 342. The data driver 31 outputs data signals for the display cells 231~234 through a data line 35. The scan driver 32 outputs scan signals S1 and S2 through scan lines 361 and 362. The display cells 331 and 333 commonly receive the scan signal S1 through the scan line 361, and the display cells 332 and 334 commonly receive the scan signal S2 through the scan line 362. The display cells 331 and 332 respectively receive the corresponding data signals commonly through the data line 35. The display cells 333 and 334 respectively receive the corresponding data signals via the switches 341 and 342. The switches 341 and 342 are respectively coupled between the data line 35 and the display cell 333, and between the data line 35 and the display cell 334.

The display cells 331 and 332 in the odd columns of the pixel matrix are respectively composed of a transistor M31 and a capacitor C31, and a transistor M32 and C32. The transistor M31 and M32 have gates respectively coupled to the scan lines 361 and 362, drains commonly coupled to the data line 35, and sources coupled to the capacitors C31 and C32. The display cells 333 and 334 in the even columns of the pixel matrix are respectively composed of a transistor M33 and a capacitor C33, and a transistor M34 and C34. The transistors M33 and M34 have gates respectively coupled to the scan lines 361 and 362, drains respectively coupled to the switches 341 and 342, and sources coupled to the capacitors C33 and C34. The switches 341 and 342 are transistors M35 and M36 respectively. The transistor M35 has a gate coupled to the scan line 362 and the transistor M36 has a gate coupled to the scan line for the next row.

Figure 3B:
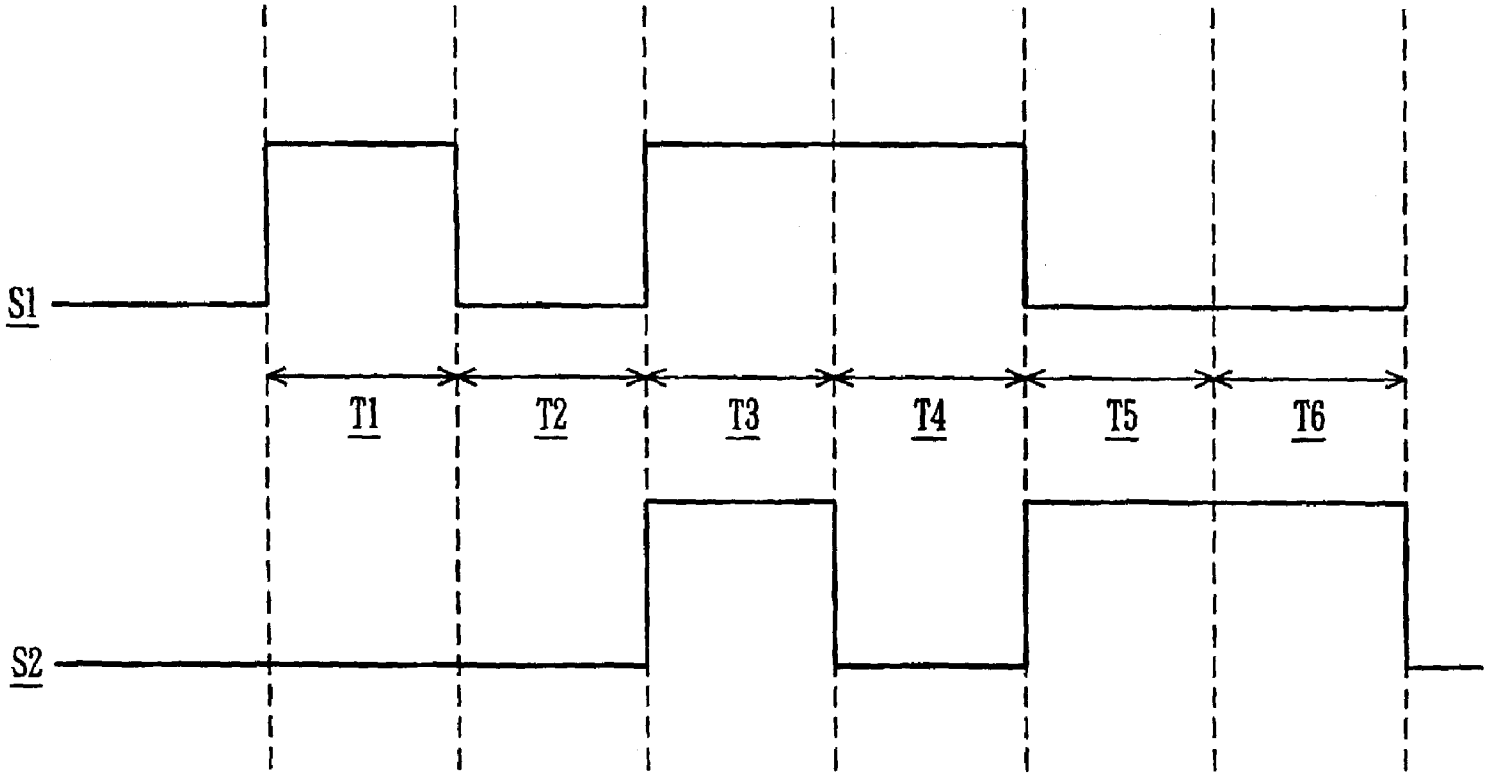

FIG. 3B is a diagram showing signal timing of the driving circuit in FIG. 3A. By comparing the signal timing shown in FIGS. 2B and 3B, it is noted that the signal Swing is integrated into the scan signals S1 and S2 shown in FIG. 3B. That is to say, the scan driver 22 outputs the scan signal comprising the signal Swing.

During periods T1 and T2, the signal S1 respectively carries a logic high and low level controlling the switches in a previous row (not shown) of the pixel matrix. The signal S2 stays at the logic low level. Therefore, the display cells 331~334 are not yet activated.

The scan period when the scan signal S1 is asserted (has a logic high level) is divided into two sub-periods T3 and T4, and the signal S2 is used as the signal Swing for the switches 341 and 342. During the period T3, the signal S2 has a high logic level to turn on the transistor M35 (closes the switch 341). The display cell 333 in the even column of the pixel matrix receives the data signal from the data driver 31 through the data line 35. During the period T4, the transistor M35 is turned off (the switch 341 is opened) by the signal S2. The display cell 331 in the odd column of the pixel matrix receives the data signal from the data driver 31 through the data line 35. It is noted that although the display cell 331 also receives the data signal for the display cell 333 during the period T3, it is refreshed by the data signal received during the period T4.

The next scan period when the scan signal 52 is asserted (has a logic high level) is divided into two sub-periods T5 and T6, the scan signal (not shown) for the display cells in the next row of the pixel matrix is used as the signal Swing. The transistors M31, M35, M33 are turned off during the periods T5 and T6. During the period T6, the transistor M36 is turned on(the switch 342 is closes) by the next scan signal. The display cell 334 in the even column of the pixel matrix receives the data signal from the data driver 31 through the data line 35. During the period T6, the transistor M36 is turned off (the switch 342 is opened) by the next scan signal. The display cell 332 in the odd column of the pixel matrix receives the data signal from the data driver 31 through the data line 35. It is noted that although the display cell 332 also receives the data signal for the display cell 334 during the period T6, it is refreshed by the data signal received during the period T6.

Figure 4A:
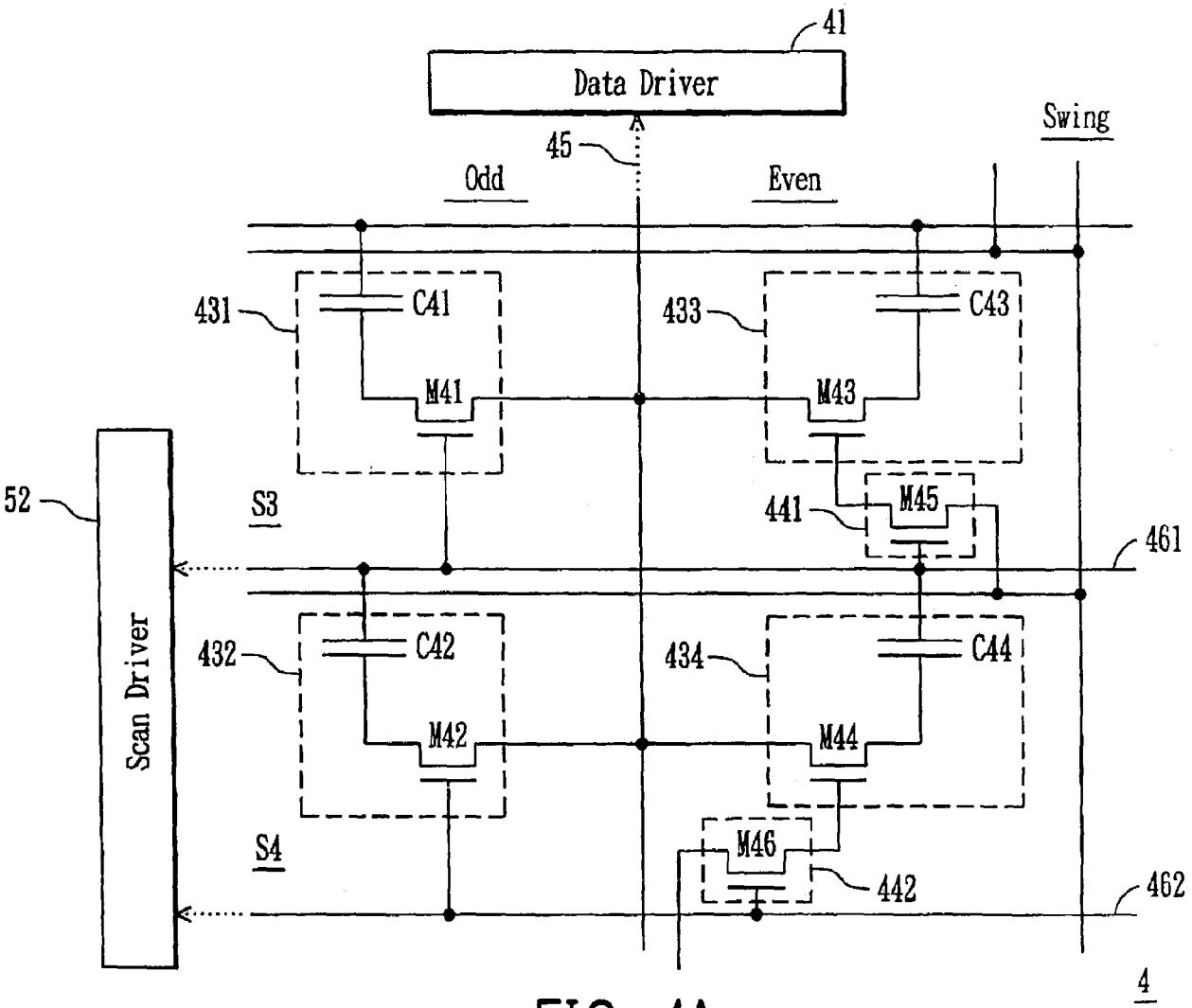
FIGS. 4A and 4B are diagrams showing a display driving circuit and signal timing thereof according to a third embodiment of the invention.

FIG. 4A is a diagram showing a display driving circuit 4 according to a third embodiment of the invention. It includes a data driver 41, a scan driver 42, a pixel matrix composed of four (for example) display cells 431~434, and two switches 441 and 442. The data driver 41 outputs data signals for the display cells 431~434 through a data line 45. The scan driver 42 outputs scan signals S3 and S4 through scan lines 461 and 462. The display cells 431~434 respectively receive the corresponding data signals commonly through the data line 45. The display cells 433 and 434 receive a signal Swing via switches 441 and 442 respectively.

The display cells 431 and 432 in the odd columns of the pixel matrix are respectively composed of a transistor M41 and a capacitor C41, and a transistor M42 and C42. The transistor M41 and M42 have gates respectively coupled to the scan lines 461 and 462, drains commonly coupled to the data line 45, and sources coupled to the capacitors C41 and C42. The display cells 433 and 434 in the even columns of the pixel matrix are respectively composed of a transistor M43 and a capacitor C43, and a transistor M44 and C44. The transistor M43 and M44 have gates respectively coupled to the switches 441 and 442, drains commonly coupled to the data line 45, and sources coupled to the capacitors C43 and C44. The switches 441 and 442 are transistors M45 and M46 respectively. The transistors M45 and M46 have gates respectively coupled to the scan lines 461 and 462 and drains coupled to receive the signal Swing.

Figure 4B:
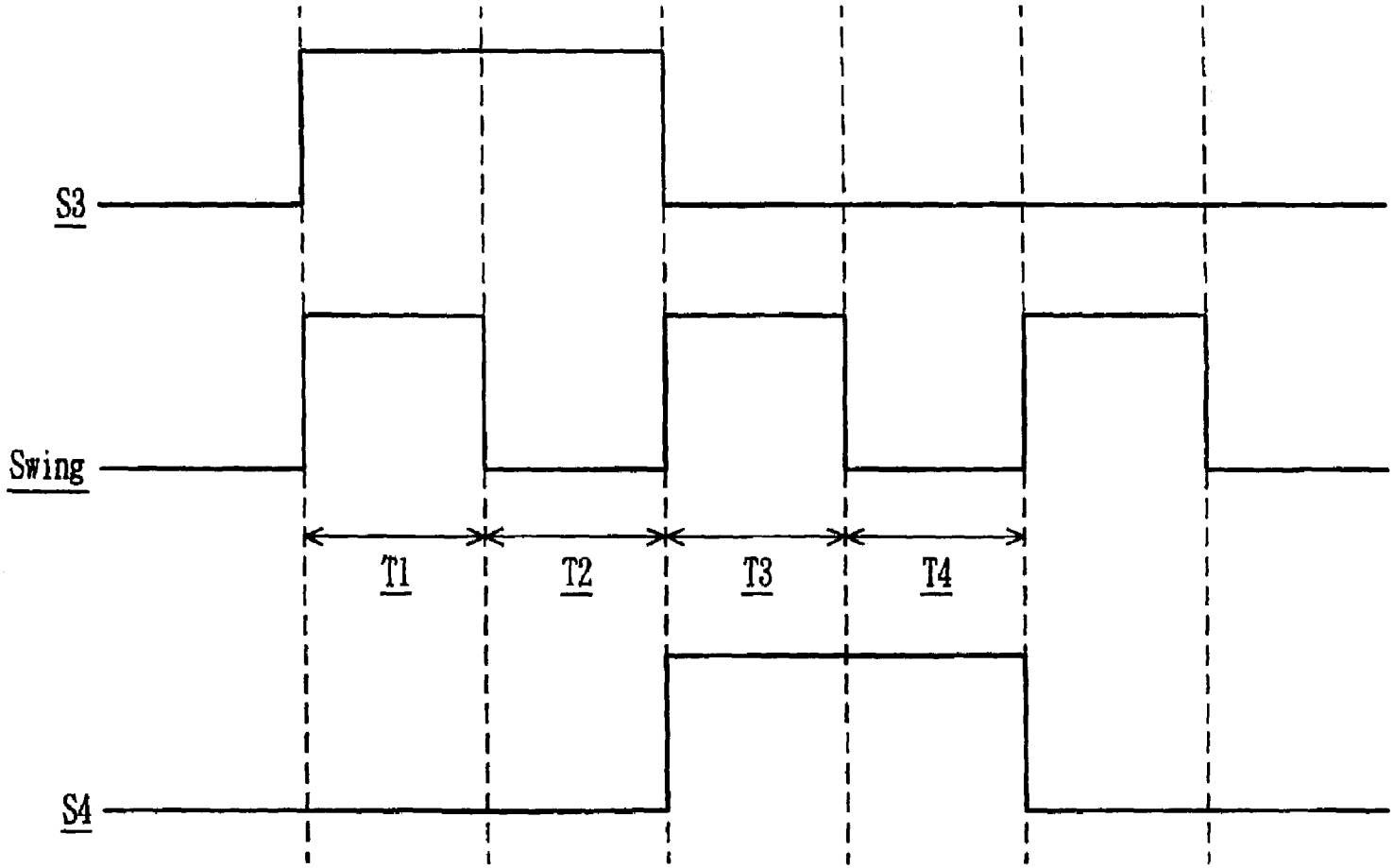

FIG. 4B is a diagram showing signal timing of the driving circuit in FIG. 4A.

The scan period when the scan signal S3 is asserted (has a logic high level) is divided into two sub-periods T1 and T2. The transistors M41 and M45 are turned on (the switches 441 is closed) during this scan period. During the period T1, the signal Swing is asserted (has a logic high level) and turns on the transistor M43. The display cell 433 in the even column of the pixel matrix receives the data signal from the data driver 41 through the data line 45. During the period T2, the transistor M43 is turned off by the signal Swing. The display cell 431 in the odd column of the pixel matrix receives the data signal from the data driver 41 through the data line 45. It is noted that although the display cell 431 also receives the data signal for the display cell 433 during the period T1, it is refreshed by the data signal received during the period T2.

The next scan period when the scan signal S4 is asserted (has a logic high level) is divided into two sub-periods T3 and T4. The transistors M42 and M46 are turned on (the switches 442 are closed) during this scan period. During the period T3, the signal Swing is asserted (has a logic high level) and turns on the transistor M4. The display cell 434 in the even column of the pixel matrix receives the data signal from the data driver 41 through the data line 45. During the period T4, the transistor M44 is turned off by the signal Swing. The display cell 432 in the odd column of the pixel matrix receives the data signal from the data driver 41 through the data line 45. It is noted that although the display cell 432 also receives the data signal for the display cell 434 during the period T3, it is refreshed by the data signal received during the period T4.

Figure 5A:
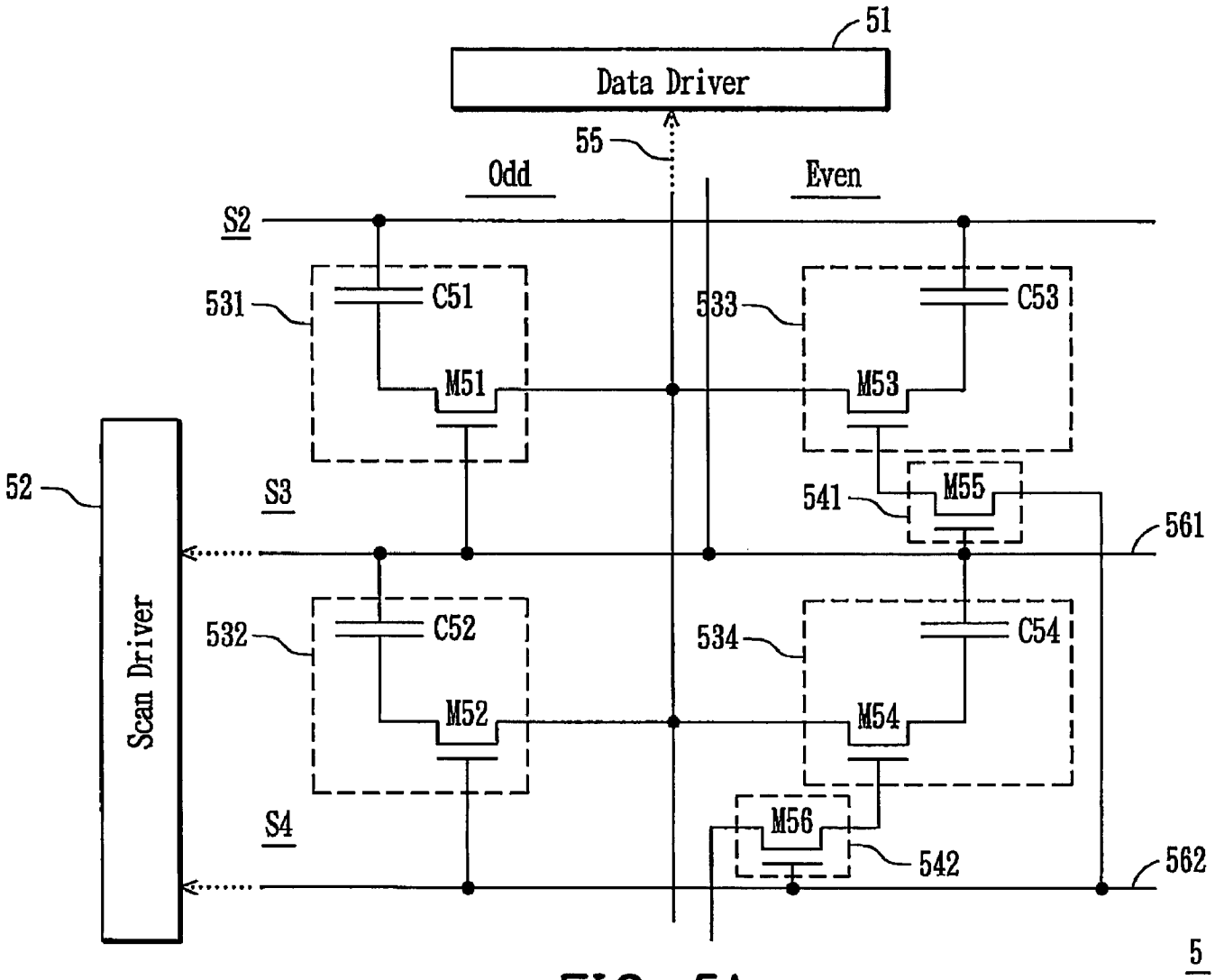
FIGS. 5A and 5B are diagrams showing a display driving circuit and signal timing thereof according to a fourth embodiment of the invention.

FIG. 5A is a diagram showing a display driving circuit 5 according to a fourth embodiment of the invention. It includes a data driver 51, a scan driver 52, a pixel matrix composed of four (for example) display cells 531~534, and two switches 541 and 542. The data driver 51 outputs data signals for the display cells 531~534 through a data line 55. The scan driver 52 outputs scan signals S3 and S4 through scan lines 561 and 562. The display cells 531~534 respectively receive the corresponding data signals commonly through the data line 55. The switches 541 and 542 are respectively coupled between the scan line 562 and the display cell 533, and between the scan line for the display cells in the next row (not shown) of the pixel matrix and the display cell 534.

The display cells 531 and 532 in the odd columns of the pixel matrix are respectively composed of a transistor M51 and a capacitor C51, and a transistor M52 and C52. The transistor M51 and M52 have gates respectively coupled to the scan lines 561 and 562, drains commonly coupled to the data line 55, and sources coupled to the capacitors C51 and C52. The display cells 533 and 534 in the even columns of the pixel matrix are respectively composed of a transistor M53 and a capacitor C53, and a transistor M54 and C54. The transistor M53 and M54 have gates respectively coupled to the switches 541 and 542, drains commonly coupled to the data line 55, and sources coupled to the capacitors C53 and C54. The switches 541 and 542 are transistors M55 and M56 respectively. The transistors M55 and M56 has gates respectively coupled to the scan lines 561 and 562 to receive the scan signals S3 and S4, and sources respectively coupled to the scan line 562 and the scan line for the next row.

Figure 5B:
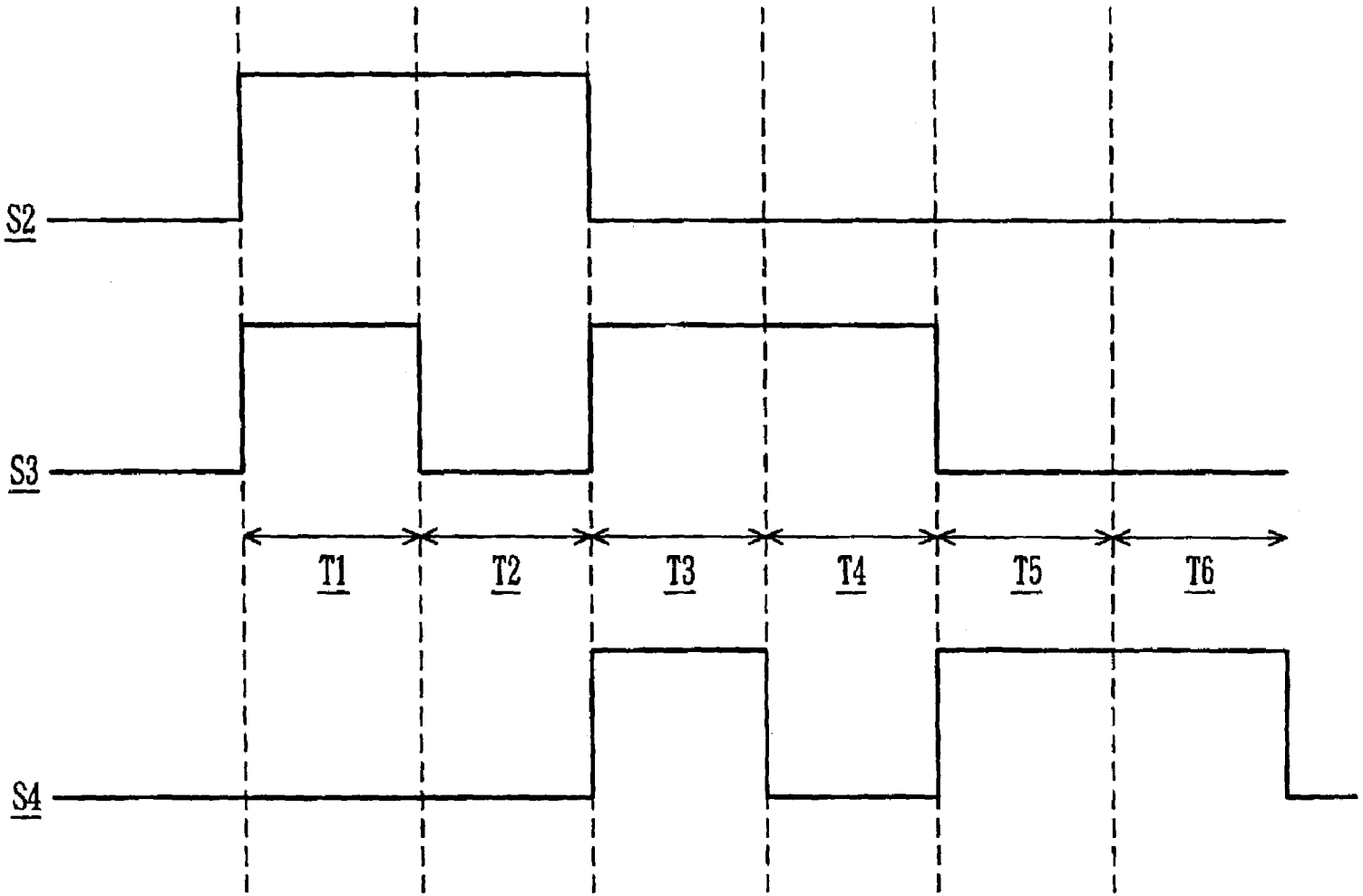

FIG. 5B is a diagram showing signal timing of the driving circuit in FIG. 5A. By comparing the signal timing shown in FIGS. 4B and 5B, it is noted that the signal Swing is integrated into the scan signals S3 and S4 shown in FIG. 5B. That is to say, the scan driver 52 outputs the scan signal comprising the signal Swing.

During periods T1 and T2, the signal S3 respectively carries a logic high and low level controlling the switches in a previous row (not shown) of the pixel matrix. The signal S4 stays at the logic low level. Therefore, the display cells 531~534 are not yet activated.

The scan period when the scan signal S3 is asserted (has a logic high level) is divided into two sub-periods T3 and T4, and the signal S4 is used as the signal Swing for the switches 541 and 542. The transistors M51 and M55 are turned on (the switches 541 is closed) during this scan period. During the period T3, the signal S4 has a high logic level to turn on the transistor M53. The display cell 533 in the even column of the pixel matrix receives the data signal from the data driver 51 through the data line 55. During the period T4, the transistor M53 is turned off by the signal S4. The display cell 531 in the odd column of the pixel matrix receives the data signal from the data driver 51 through the data line 55. It is noted that although the display cell 531 also receives the data signal for the display cell 533 during the period T3, it is refreshed by the data signal received during the period T4.

The next scan period when the scan signal S4 is asserted (has a logic high level) is divided into two sub-periods T5 and T6, the scan signal (not shown) for the display cells in the next row of the pixel matrix is used as the signal Swing. The transistors M52 and M56 are turned on (the switches 542 is closed) during this scan period. During the period T6, the transistor M54 is turned on by the next scan signal. The display cell 534 in the even column of the pixel matrix receives the data signal from the data driver 51 through the data line 55. During the period T6, the transistor M54 is turned off by the next scan signal. The display cell 532 in the odd column of the pixel matrix receives the data signal from the data driver 51 through the data line 55. It is noted that although the display cell 532 also receives the data signal for the display cell 534 during the period T6, it is refreshed by the data signal received during the period T6.

In conclusion, the present invention provides a display driving circuit with fewer data drivers. Each pair of display cells is equipped with a switch for data terminal sharing. Thus, the switching frequency of the switches is lowered to the frame rate, which eliminates the reliability issue in the conventional display driving circuit.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A display driving circuit comprising:

a data driver sequentially outputting a first, second, third and fourth data signal through a data line;

a scan driver outputting a first and second scan signal through a first and second scan line respectively;

a first, second, third and fourth display cell respectively receiving the first, second, third and fourth data signal through the data line, the first and second display cell commonly receiving the first scan signal through the first scan line, and the third and fourth display cell commonly receiving the second scan signal through the second scan line;

a first switch electrically coupling the first display cell to the data line when the first switch is turned on, such that the first data signal is provided to the first display cell, and electrically isolating the first display cell from the data line when the first switch is turned off, such that the second data signal is provided to the second display cell; and a second switch electrically coupling the third display cell to the data line when the second switch is turned on, such that the third data signal is provided to the third display cell, and electrically isolating the third display cell from the data line when the second switch is turned off, such that the fourth data signal is provided to the fourth display cell.

2. The circuit as claimed in claim 1, wherein the first switch is coupled between the data line and the first display cell, and the second switch is coupled between the data line and the third display cell.

3. The circuit as claimed in claim 2, wherein the first switch is a transistor having a gate coupled to the second scan line, and the second scan signal comprises a swing signal controlling the first switch.

4. The circuit as claimed in claim 2, wherein the first and second switch are respectively a first and second transistor having gates coupled to receive a swing signal controlling the first and second switch.

5. A display driving circuit comprising:

a data driver sequentially outputting a first, second, third and fourth data signal through a data line;

a scan driver outputting a first and second scan signal through a first and second scan line respectively;

a first, second, third and fourth display cell respectively receiving the first, second, third and fourth data signal through the data line, the first and second display cell commonly receiving the first scan signal through the first scan line, and the third and fourth display cell commonly receiving the second scan signal through the second scan line;

a first switch coupled to the first display cell, switched by the first scan signal, and receiving a swing signal, wherein the first display cell receives the swing signal when the first switch turned on, and according to the swing signal, the first data signal is provided to the first display cell or the second data signal is provided to the second display cell; and a second switch coupled to the third display cell, switched by the second scan signal, and receiving the swing signal, wherein the third display cell receives the swing signal when the second switch turned on, and according to the swing signal, the third data signal is provided to the third display cell or the fourth data signal is provided to the fourth display cell.

6. The circuit as claimed in claim 5, wherein the first switch is a transistor having a source coupled to the second scan line and a gate coupled to the first scan line, and the second scan signal comprises the swing signal.

7. The circuit as claimed in claim 5, wherein the first and second switch are a first and second transistor having gates coupled to the first and second scan line respectively and drains coupled to receive the swing signal.

8. A display driving circuit comprising:

a data driver sequentially outputting a data signal through a data line;

a scan driver outputting a scan signal through a data line;

a first transistor having a gate coupled to the scan line and a drain coupled to the data line;

a second transistor having a gate coupled to receive a swing signal and a drain coupled to the data line, and being sequentially turned on and off by the swing signal when the first transistor is turned on;

a third transistor having a gate coupled to the scan line and a drain coupled to a source of the second transistor; and a first and second capacitor respectively coupled to sources of the first and third transistor.

9. The circuit as claimed in claim 8, wherein the scan driver further comprises a second scan line and the circuit further comprises:

a fourth transistor having a gate coupled to the second scan line and a drain coupled to the data line; and a third capacitor coupled to a source of the fourth transistor.

10. The circuit as claimed in claim 9, wherein the scan driver outputs the swing signal through a second scan line and the gate of the second transistor is coupled to the second scan line to receive the swing signal.

11. A display driving circuit comprising:

a data driver sequentially outputting a data signal through a data line;

a scan driver outputting a scan signal through a scan line;

a first transistor having a gate coupled to the scan line and a drain coupled to the data line;

a second transistor having a drain coupled to the data line;

a third transistor having a gate coupled to the scan line, a source coupled to a gate of the second transistor and a drain coupled to receive a swing signal, wherein when the third transistor is turned on, the gate of the second transistor is coupled to the source of the third transistor to receive the swing signal and the second transistor is sequentially turned on and off; and a first and second capacitor respectively coupled to the sources of the first and second transistor.

12. The circuit as claimed in claim 11, wherein the scan driver further comprises a second scan line and the circuit further comprises:

a fourth transistor having a gate coupled to the second scan line and a drain coupled to the data line; and a third capacitor coupled to a source of the fourth transistor.

13. The circuit as claimed in claim 12, wherein the scan driver outputs the swing signal through the second scan line and the drain of the third transistor is coupled to the second scan line to receive the swing signal.

* * * * *

UNITED STATES PATENT AND TRADEMARK OFFICE

CERTIFICATE OF CORRECTION

PATENT NO. : 7,102,630 B2
APPLICATION NO. : 10/411935
DATED : September 5, 2006
INVENTOR(S) : Biing-Der Liu, Jia-Fam Wong and Yao-Jen Hsieh It is certified that error appears in the above-identified patent and that said Letters Patent is hereby corrected as shown below:

Col. 8, line 49, the word “data” should be --scan--.

Signed and Sealed this

Thirtieth Day of January, 2007

JON W. DUDAS
*Director of the United States Patent and Trademark Office*